US006478654B1

(12) United States Patent
Rehkemper et al.

(10) Patent No.: US 6,478,654 B1
(45) Date of Patent: Nov. 12, 2002

(54) TOY VEHICLE COLLISION COURSE

(75) Inventors: Steven Rehkemper; Jeffrey Rehkemper; Peter Greenley, all of Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 09/556,999

(22) Filed: Apr. 24, 2000

(51) Int. Cl.[7] ..... A63H 17/00

(52) U.S. Cl. ..... 446/431; 446/444; 446/429; 104/54; 104/55; 104/53

(58) Field of Search ..... 446/431, 444, 446/168, 169, 170, 171, 172, 173; 104/53, 54, 55

(56) References Cited

U.S. PATENT DOCUMENTS

| | | | | | |
|---|---|---|---|---|---|
| 812,595 | A | * | 2/1906 | Roberts | 104/54 |
| 1,527,006 | A | * | 2/1925 | O'Reilly | 104/55 |
| 1,603,180 | A | * | 10/1926 | Zabel | 104/55 |
| 2,571,521 | A | * | 10/1951 | Barnhart | 446/168 |
| 3,411,783 | A | * | 11/1968 | Montagna | 104/55 |
| 3,908,989 | A | * | 9/1975 | Meyer | 446/444 |
| 4,091,561 | A | * | 5/1978 | Kimura | 238/10 C |
| 4,128,964 | A | * | 12/1978 | Ogasawara | 446/168 |
| 4,357,778 | A | * | 11/1982 | Matsumoto et al. | 446/444 |
| 4,425,735 | A | * | 1/1984 | Kulesza et al. | 446/444 |
| 4,516,953 | A | * | 5/1985 | Hippely et al. | 446/444 |
| 4,519,789 | A | * | 5/1985 | Halford et al. | 446/444 |
| 4,609,363 | A | * | 9/1986 | Udagawa | 446/444 |
| 5,102,133 | A | * | 4/1992 | Chilton et al. | 446/444 |
| 5,205,554 | A | * | 4/1993 | Copson | 446/444 |
| 5,299,969 | A | * | 4/1994 | Zaruba | 446/444 |
| 5,683,298 | A | * | 11/1997 | Jackson | 446/444 |
| 5,899,789 | A | * | 5/1999 | Rehkemper et al. | 446/444 |
| 6,241,573 | B1 | * | 6/2001 | Ostendorff et al. | 446/444 |

* cited by examiner

*Primary Examiner*—Jacob K. Ackun
*Assistant Examiner*—Urszula Cegielnik

(57) ABSTRACT

A collision course including at least two vertically stacked looping track sections, each looping track section starts at a beginning area that connects to an upwardly extending curved section that peaks at an apex and then travels along a downwardly extending curved section. In order to stack the looping track sections vertically each looping track section is unsymmetrical. The downwardly extending curved sections feed into the beginning areas of the succeeding looping track section, and the downwardly extending curved section of the last (or third) looping track section feeds into the beginning area of the first looping track section. Each looping track section further intersects with another looping track section to define junctions. Gaps formed in each intersecting track section permit a vehicle to travel through the intersection unobstructively. If, however, two or more vehicles enter the same junction and the same time a mid-air collision can occur, when the vehicles come in contract adjacent the same gap.

20 Claims, 3 Drawing Sheets

TOY VEHICLE COLLISION COURSE

FIELD OF THE INVENTION

This invention relates to toy vehicles and more particularly, to a toy vehicle collision course having more then one intersection in which toy vehicles may crash into each other.

BACKGROUND OF THE INVENTION

There are a variety of toy vehicle track assemblies that include continuous and non-continuous tracks for impelled or self-powered toy vehicles. These track assemblies are compiled of track sections that connect together to allow various track layouts to be constructed. To enhance appealing qualities of the track assemblies various accessories may be added, for example, impelling mechanisms may be used to propel the vehicles through the track assemblies or looping sections may be used to increase appealing qualities of the track assemblies. The use of multiple looping track sections have also been provided in prior track assemblies. However, multiple looping track sections are typically only provided in linear succession of loops. This tends to extend the track assemblies and thereby takes up a lot of horizontal space.

Other track assemblies may include crash collision courses, which connect two or more intersecting track sections or may narrow the track from a double to a single track line, providing for the possibility of two or more vehicles colliding into each other if the vehicles enter the intersection at the same time. Generally, such intersecting or narrowing track sections provide for a single intersection where the vehicles may collide.

As such a need exists to provide multiple-looping sections in a vertical, not horizontal, succession. Meaning that the assembled multiple-looping sections can remain assembled because it uses minimal space. Also, providing multiple collision intersections within the multiple looping sections further increases the enjoyment available from the track assemblies.

SUMMARY OF THE INVENTION

In accordance with the present invention, there is provided a vertically disposed collision course having at least two vertically stacked looping track sections. Each looping track section is so configured that a portion thereof intersects with a portion of another looping track section, such that a mid-air collision with one or more vehicles may occur.

The illustrated embodiment, which is by way of example, includes three vertically disposed looping track sections, each looping track section begins at a beginning area that connects to an upwardly extending curved section, peaks at an apex, and then travels along a downwardly extending curved section. The upwardly and downwardly extending curved sections may each be separately divided into a lower and upper portion. The lower portion of the downwardly extending curved section of a looping track section connects (or feeds into) to the beginning area of the succeeding looping track section. To complete the course, the downwardly extending curved section of the last (or third) looping track section feeds into the beginning area of the first looping track section. Each vertically disposed looping track section is furthermore, unsymmetrical, causing the ending area of a looping track section to be positioned at a height different than the position of looping track section's beginning area Also, each beginning area of the vertically looping track sections is positioned at a height directly above or below the other beginning areas, creating vertical stacked looping sections that are substantially planar in respect to each other.

Each looping track section further intersects with other looping track sections to define four junctions. To permit a vehicle to travel through the junction, on either intersecting track section, each track section has a gap formed at such intersection. These gaps are sufficiently sized to allow the vehicle to travel un-obstructively through such intersection, and exit the junction on the same track section the vehicle was traveling on when it entered the junction. While the gaps are sufficiently sized to permit the vehicle to travel over or through the gaps, the gaps also provide the means for a collision between the vehicles. If at any time two vehicles traveling along different track sections enter the same junction a mid-air collision will occur, if the vehicles comes into contact with each other while traveling through or over the same gap within the junction.

To impel the vehicles through the vertically disposed looping track section, three pairs of drive rollers are positioned separately about each beginning area. Since each beginning area is positioned at a height above another beginning area, the drive rollers may be vertically stacked and rotatably driven by a single pair of axles.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
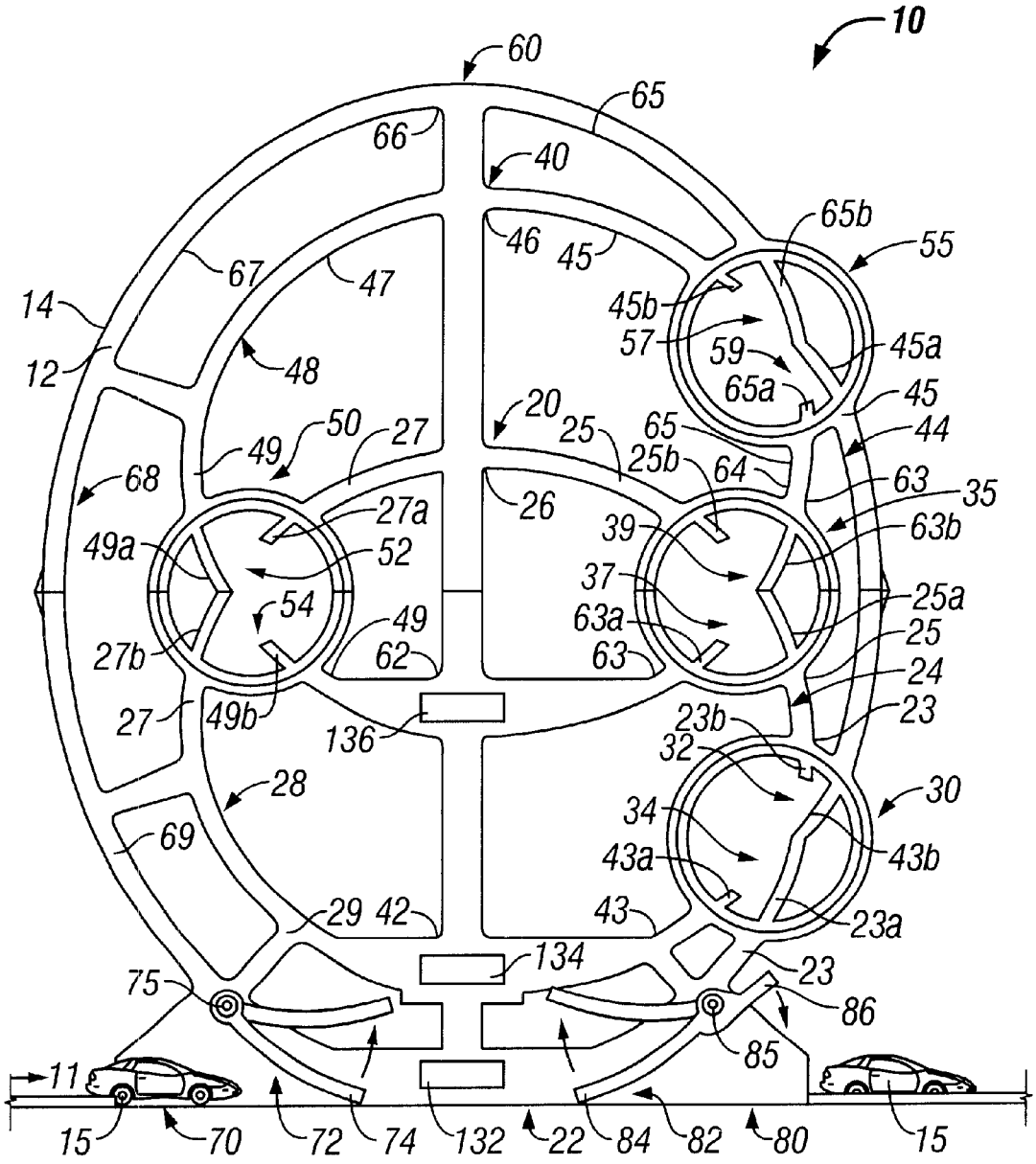
FIG. 1 is a front view of the collision course showing at least three loop sections intersecting to form at least four junctions.

While the invention is susceptible to embodiments in many different forms there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring first to FIG. 1, there is illustrated a vertical collision course 10 for which a toy vehicle 15, either freewheel or battery operated, may move there through. The vertical collision course 10 depicted is but one configuration that may be employed. As illustrated, the course 10 has a front side 12 and a back side 14, and contains a plurality of track sections. When the front and back side are connected to each other (FIG. 3), through any suitable connecting means in the art, the plurality of track sections map out at least two continuous vertical looping track sections. As illustrated throughout the Figures, the illustrated embodiment includes three looping sections defined as a first vertical loop 20, a second vertical loop 40 (or intermediate) and a third vertical loop (or last loop) 60. These looping sections intersect each other at a first 30, second 35, third 50 and fourth 55 junction to provide multiple collision areas within the collision course 10, discussed in further detail below. The vertical collision course 10 further contains lateral members 17 (shown in FIG. 2), which support the collision course in an upright vertical configuration, and frame members 19, placed along the plurality of track sections, to support the looping track sections.

Generally each vertical loop may be defined along similarly situated track sections. For instance, the first vertical loop 20 begins at a first beginning area 22 and proceeds to a first upwardly curved section 24 that is divided into a lower portion 23 and an upper portion 25. Following the upper portion 25, the first loop 20 peaks at a first apex 26 and then continues to a first downwardly extending curved section 28, which is also divided into an upper portion 27 and a lower portion 29. The first vertical loop 20 ends thereafter (or feeds into) to the second beginning area 42, which begins the second vertical loop 40. Similarly configured as the first vertical loop 20, the second vertical loop 40 moves along a lower portion 43 and an upper portion 45 of a second upwardly extending section 44. The second loop 40 peaks at a second apex 46 and then travels downwardly along an upper portion 47 and a lower portion 49 of a second downwardly extending curved section 48. From the lower portion 49, the second vertical loop 40 feeds into a third beginning area 62 defining the beginning of the third vertical loop 60. The third vertical loop 60 proceeds thereafter to a lower portion 63 and then to an upper portion 65 of a third upwardly extending curved section 64. The third vertical loop 60 peaks at a third apex 66 and moves downwardly along an upper portion 67 and a lower portion 69 of a third downwardly extending curved section 68. Traveling along from the lower portion 69, the third vertical loop 60 (or the last loop on a multiple looping track section) re-connects to the first beginning area 22.

Each succeeding vertically disposed loop section has a beginning area positioned directly above the beginning area of the preceding vertically disposed loop section. This permits the loop sections to be stacked above each other, making the collision course horizontally compact. To provide vertically stacked loop sections, each vertical loop is unsymmetrical meaning that it has an upwardly extending curved section that is either longer or shorter then a downwardly extending curved section. This permits the first vertical loop 20 to end at the second beginning area 42, which is at a predetermined height above the first beginning area 22. Similarly the second vertical loop 40 ends at the third beginning area 62, positioned above the second beginning area 42. In order to complete the course 10, the third vertical loop 60 ends at the first beginning area 22, which is positioned below the third beginning area 62. Also, each beginning area is vertically positioned directly above each other, permitting the course to be compact in both the horizontal and vertical planes.

Figure 2:
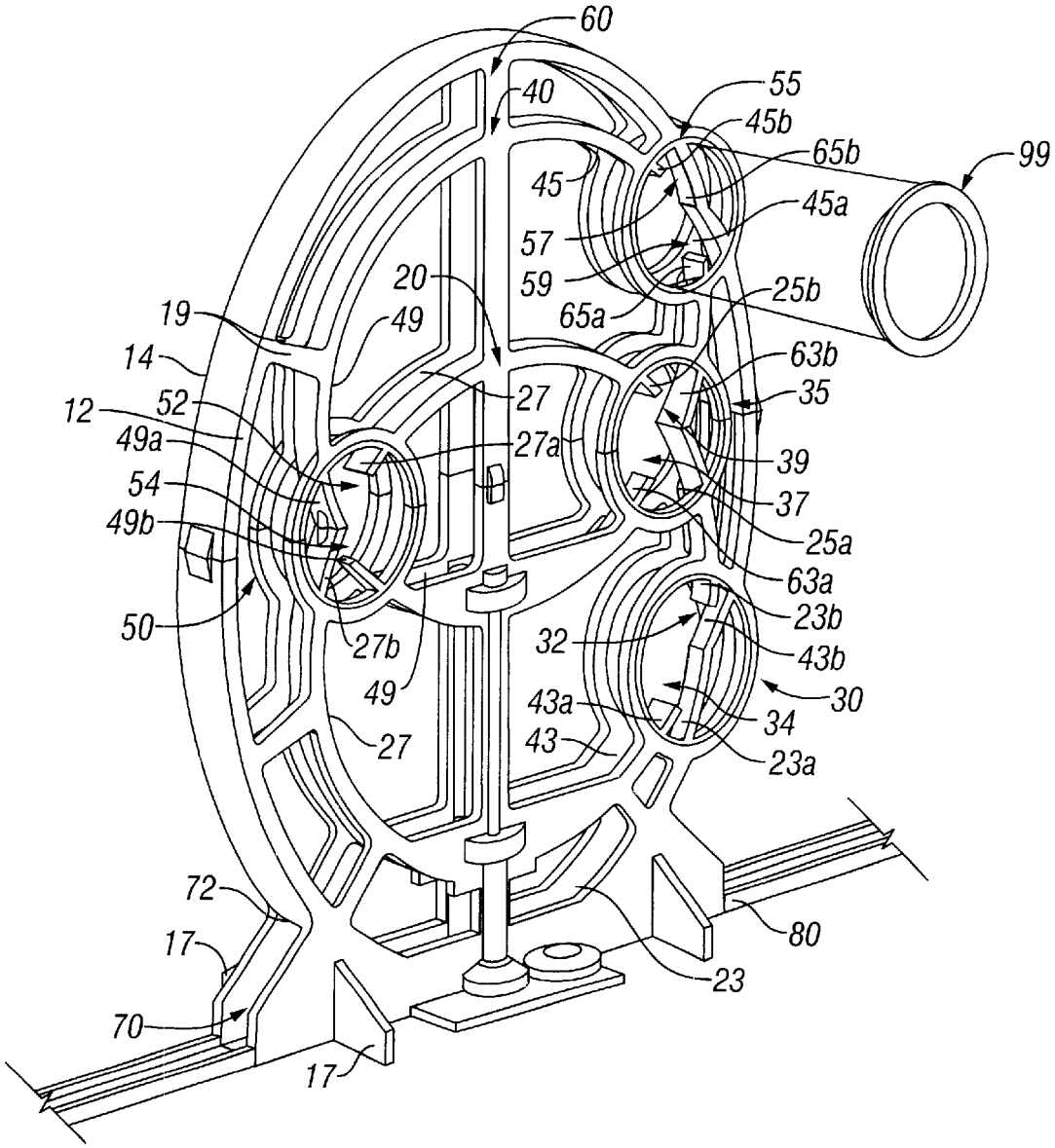
FIG. 2 is a three-dimensional prospective view of FIG. 1.
Figure 3:
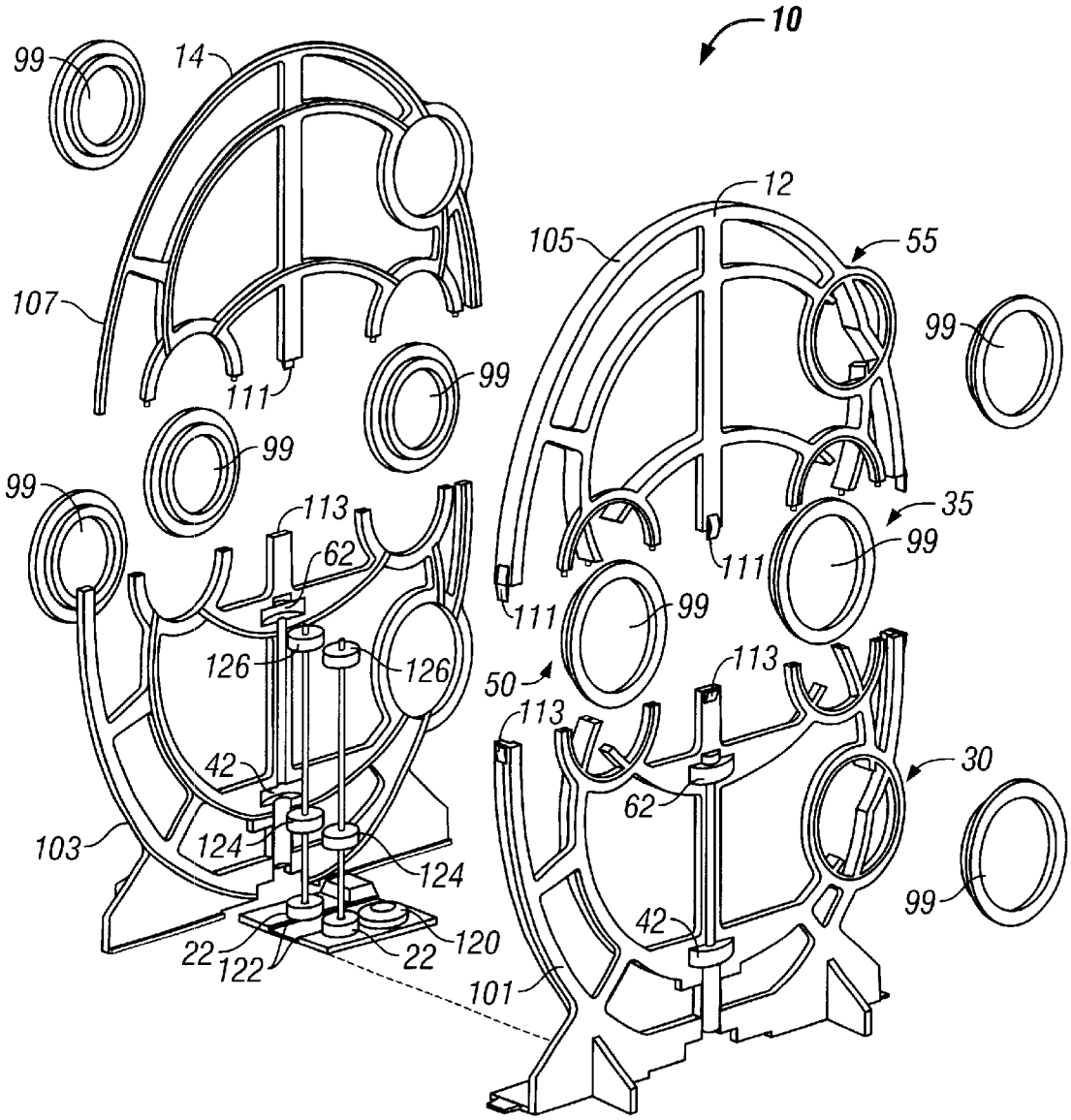
FIG. 3 is an exploded view of the collision course.

For more specific information regarding the configuration of the collision course 10 reference is made to FIGS. 1–3. It is seen that the collision course 10 includes an entrance section 70 (best seen in FIG. 2) that permits a vehicle 15 to enter the vertical collision course 10. The entrance section 70 intersects the lower portion 69 of the. third downwardly extending curved section 68. At the intersection, the lower portion 69 of the third downwardly extending curved section 68 includes an entrance gap 72 in the track section. The entrance gap 72 is sized accordingly to permit the vehicle 15 to travel there-through to the first beginning area 22 of the first loop 20. To ensure that the path of a vehicle moving along the third downwardly extending curved section 68 is continuous over the entrance gap 72, a downwardly curved entrance door 74 is pivotally attached to the lower portion 69 over the entrance gap 72. The entrance door 74 pivots about a pin 75 and includes a spring (not shown) that biases the entrance door 74 downwardly, such that a vehicle traveling along the third downwardly extending curved section 68 will travel over the entrance door 74 to the first beginning area 22. Moreover, the vehicle 15 entering the course 10 will push and pivot the entrance door 74 upwardly, such that the vehicle 15 may travel through the entrance gap 72 to the first beginning area 22.

The vertical collision course 10 also includes an exit section 80. The exit section 80 intersects with the lower portion 23 of the first upwardly extending curved section 24. An exit gap 82 formed in the lower portion 23 of the first upwardly extending curved section 24 is sized accordingly to permit a vehicle to travel through the exit gap 82 and leave the course 10. Since vehicles enter the first beginning area 22 from both the entrance section 70 and the third loop 60, the lower portion 23 includes an upwardly extending exit door 84, over the exit gap 82. The exit door 84 is pivotally attached to the lower portion 23 about a pin 85 and includes a spring (not shown) that biases the exit door 84 downwardly. When the exit door 84 is down, a vehicle is directed upwardly along the exit door 84, over the exit gap 82, and into the first vertical loop 20. However, by applying a downwardly force against a door lever 86, the exit door 84 pivots upwardly about the pin 85 such that vehicles proceeding from the third loop 60 may exit the course through the exit gap 82.

Furthermore, the exit section 80, as well as the entrance section 70, is sized accordingly to permit the vertical collision course 10 to be connected to track sections from other track assemblies, allowing the course 10 to either be an accessory for other track assemblies or a stand only unit.

Best seen in FIG. 3, the collision course 10 also includes a first, second and third pair of power drive rollers 122, 124 and 126, respectively, to impel freewheel toy vehicles through the vertical collision course 10. The first pair of rollers 122 is housed within a first booster area 132, which is positioned at the first beginning area 22 of the first loop 20; the second pair of rollers 124 is housed within a second booster area 134, which is positioned at the second beginning area 42; and the third pair of rollers 126 is housed within a third booster area 136, which is positioned at the third beginning area 62 of the third loop 60. When a vehicle 15 enters the beginning area 22 of the first loop 20, the vehicle 15 travels through the first booster area 132 and is engaged by the first pair of rollers 122. The first pair of rollers 122 impels the vehicle 15 through the first loop 20 to the second beginning area 42, when the upwardly extending exit door 84 is in the down position. Each pair of rollers, similarly engage and impel the vehicle through its respective loop, discussed in greater detail below.

As mentioned above, the collision course includes at least four junctions, best seen in FIGS. 1 and 2, (the first 30, second 35, third 50, and fourth 55 junction), similarly configured. Each junction is formed by intersecting at least two track sections. To permit a vehicle to travel through the junction, on either intersecting track section, each track section has a gap formed at the intersection. The gaps are sufficiently sized to allow the vehicle to travel un-obstructively through the intersection, such that the vehicle may exit the junction on the same track section the vehicle was traveling on prior to entering the junction.

As mentioned above, a vehicle 15 entering the first booster area 132 is engaged by the first pair of rollers 122 and impelled through the first loop 20. The vehicle 15 will travel upwardly along the lower portion 23 of the first upwardly curved section 24 to the first junction 30. The first junction 30 is defined by intersecting the lower portion 23 of the first upwardly extending curved section 24 and the lower portion 43 of the second upwardly extending curved section 44. A gap 32 formed in the lower portion 23 of the first upwardly extending curved section 24, separates the lower portion 23 into two track sections 23*a* and 23*b*. Similarly, a gap 34 is formed in the lower portion 43 of the second upwardly extending curved section 44 and divides this lower portion 43 into two track sections 43*a* and 43*b*. As stated above, the gaps are sufficiently sized to allow the vehicle 15 to travel un-obstructively through the intersection.

The vehicle 15 entering the first junction 30, along the first upwardly extending curved section 24, will travel along the track section 23*a*. The vehicle will travel through the gap 34, formed in the lower portion 43 of the second upwardly extending curved section 44, and over the gap 32, formed in the lower portion 23 of the first upwardly extending curved section 24. Once through the gap 32, the vehicle will continue to travel along the track section 23*b* and exit the first junction 30 along the lower portion 23 of the first upwardly extending curved section 24.

Similarly, a vehicle entering the first junction 30 along the lower portion 43 of the second upwardly extending curved section 44, will travel along the track section 43*a*. The vehicle will travel over the gap 34 formed in the lower portion 43 of the second upwardly extending curved section 44 and through the gap 32 formed in the lower portion 23 of the first upwardly extending curved section 24. The vehicle will continue along the track section 43*b* and exit the first junction 30 by continuing to travel along the lower portion 43 of the second upwardly extending curved section 44.

While the gaps are sufficiently sized to permit the vehicle to travel over or through the gap, if at any time two vehicles traveling along different track sections enter the same junction (of the first 30, the second 35, the third 50 or the fourth 55 junction) a mid-air collision will occur, if the vehicles comes into contact with each other while traveling through or over the same gap within the junction.

Traveling through the first junction 30, along the lower portion 23 of the first upwardly extending curved section 24, the vehicle 15 continues along the upper portion 25 thereof and to the second junction 35. The second junction 35 is defined by intersecting the upper portion 25 of the first upwardly extending curved section 24 with the lower portion 63 of the third upwardly extending curved section 64. A gap 39 formed in the upper portion 25 of the first upwardly extending curved section 24, separates the upper portion 25 into two track sections 25*a* and 25*b*. Similarly, a gap 37 is formed in the lower portion 63 of the third upwardly extending curved section 64 and divides this lower portion 63 into two track sections 63*a* and 63*b*.

The vehicle 15 traveling through the second junction 35 (along the upper portion 25 of the first upwardly extending curved section 24) travels along the track section 25*a*. The vehicle continues through the gap 37 formed in the lower portion 63 of the third upwardly extending curved section 64 and over the gap 39 formed in the upper portion 25 of the first upwardly extending curved section 24. The vehicle 15 traversing the two gaps 37 and 39 continues to travel along the track portion 25*b* and exits the second junction 35 along the upper portion 25 of the first upwardly extending curved section 24.

Proceeding from the second junction 35, the vehicle 15 travels inverted through the first apex 26, and then downwardly along the upper portion 27 of the first downwardly extending curved section 28 to the third junction 50. The third junction 50 is defined by intersecting the upper portion 27 of the first downwardly extending curved section 28 with the lower portion 49 of the second downwardly extending curved section 48. A gap 52 formed in the upper portion 27 of the first downwardly extending curved section 28, separates the upper portion 27 into two track sections 27*a* and 27*b*. Similarly, a gap 54 is formed in the lower portion 49 of the second downwardly extending curved section 48 and divides this lower portion 49 into two track sections 49*a* and 49*b*.

The vehicle 15 (traveling along the upper portion 27 of the first downwardly extending curved section 28) enters the third junction 50 along the track section 27*a* and passes over the gap 52 formed in the upper portion 27 of the first downwardly extending curved section 28. The vehicle 15 continues to travel through the gap 54 formed in the lower portion 49 of the second downwardly extending curved section 48. The vehicle 15, traveling through the intersection, continues along the track section 27*b* and exits the third junction 50 along the upper portion 27 of the first downwardly extending curved section 28.

Continuing from the third junction 50, the vehicle 15 travels downwardly along the lower portion 29 of the first downwardly extending curved section 28 and travels to the second beginning area 42 of the second vertical loop 40. The vehicle 15 moves through the second booster area 134 and is impelled through the second loop 40 by the second pair of rollers 124. Traveling upwardly along lower portion 43 of the second upwardly extending curved section 44, the vehicle returns to the first junction 30. The vehicle, as described above, enters and exits the first junction 30 along the lower portion 43 of the second upwardly extending curved section 44 and continues upwardly along the upper portion 45 to the fourth junction 55.

The fourth junction 55 is defined by intersecting the upper portion 45 of the second upwardly extending curved section 44 with the upper portion 65 of the third upwardly extending curved section 64. A gap 57 formed in the upper portion 45 of the second upwardly extending curved section 44, separates the upper portion 45 into two track sections 45*a* and 45*b*. Similarly, a gap 59 is formed in the upper portion 65 of the third upwardly extending curved section 64 and divides this upper portion 65 into two track sections 65*a* and 65*b*.

The vehicle 15 enters the fourth junction 55, along the upper portion 45 of the second upwardly extending curved section 44 and travels along the track section 45*a*. The vehicle continues through the gap 59 formed in the upper portion 65 of the third upwardly extending curved section 64 and over the gap 57 formed in the upper portion 45 of the second upwardly extending curved section 44. The vehicle 15 continues along the track section 45*b* and exits the fourth junction 55 along the upper portion 45 of the second upwardly extending curved section 44.

Moving from the fourth junction 55, the vehicle 15 continues through the second apex 46 and to the upper portion 47 and the lower portion 49 of the second downwardly extending curved section 48. Traveling on the lower portion 49, the vehicle 15 returns to the third junction 50. The vehicle 15 travels along the track section 49*a* and travels through the gap 52 formed on the upper portion 29 of the first downwardly extending curved section 28. The vehicle then travels over the gap 54 formed in the lower portion 49 of the second downwardly extending curved section 48 and continues to travel along the other track section 49*b*. The vehicle 15 then exits the third junction 50 along the lower portion 49 of the second downwardly extending curved section 48 and continues to the third beginning area 62, of the third loop 60.

The vehicle 15 enters the third booster area 136 and is engaged and impelled by the third pair of rollers 126. Traveling upwardly along the lower portion 63 of the third upwardly extending curved section 64 the vehicle 15 re-enters the second junction 35. The vehicle 15 travels along the track section 63*a* and over the gap 37 formed in the lower portion 63 of the third upwardly extending curved section 64. The vehicle then travels through the gap 39 formed on the upper portion 25 of the first upwardly extending curved section 24 and continues along the track section 63*b*. The vehicle 15 exiting the second junction 35 from the lower portion 63 of the third upwardly extending curved section 64 travels along the upper portion 65 thereof and enters the fourth junction 55.

Entering the fourth junction 55, the vehicle 15 travels on the track section 65*a*, which is part of the upper portion 65 of the third upwardly extending curved section 64. The vehicle 15 moves over the gap 59 formed in upper portion 65 of the third upwardly extending curved section 64 and through the gap 57 formed in the upper portion 45 of the second upwardly extending curved section 44. The vehicle 15 traveling over the gap 59 and through the other gap 57 continues to travel along track section 65*b* and exits the fourth junction 55 by traveling along the upper portion 65 of the third upwardly extending curved section 64.

Thereafter the vehicle 15 travels through the third apex 66 and then downwardly along the upper portion 67 and then the lower portion 69, of the third downwardly extending curved section 68. The vehicle then travels over the entrance door 74, and is directed to the first beginning area 22. Through the first beginning area 22, the vehicle 15 may either be redirected back through the first vertical loop 20, when the exit door 82 is in the downward position, or may leave the vertical collision course 10, when the exit door 82 is in the upward position.

Referring to FIG. 3, an exploded view of the vertical collision course 10 is illustrated. As depicted, the course 10 may be integrally molded from four halves, a front and back lower half 101 and 103 and a front and back upper half 105 and 107, respectively. The halves may interconnect by any suitable connecting means, such as males and female snaps 111 and 113, respectively.

As illustrated, each pair of drive rollers is separately housed in the front and back lower half 101 and 103 of the course 10. Since the three loops are vertically stacked in a substantially planar configuration, the three vertically stack pairs of drive rollers 122, 124 and 126 may be rotatably driven by a single drive mechanism 120. A suitable power source that operates the drive mechanism 120, such as batteries, is supplied thereto. Through suitable gear mechanisms, the drive mechanism 120 rotates a single pair of vertically positioned axles 138, which the three pairs of rollers are vertically stacked and attached thereto. Each pair of drive rollers also has an outwardly cushioned surface to facilitate contact with the vehicle during its movement there-between.

If additional vertical loop sections are added to the collision course 10 additional pairs of drive rollers may also be similarly attached. It is also contemplated by the present invention that not all loop sections employ a pair of rollers. For instance a single pair of rollers may be incorporated to impel a vehicle throughout the entire course, or if the vehicle were battery operated itself, no rollers would be required.

Moreover, while the illustrated embodiment includes three vertically stacked loop sections, it is contemplated by the present invention that the preferred embodiment may include two vertically stacked loop sections (a first and last loop section). As such, the two vertically stacked loop sections would each preferably include a pair of drive rollers, attached as described above. In the embodiment with two vertically stacked loop sections, the two vertically stacked loop sections would intersect with each other to form at least one junction.

A pair of clear discs 99 (FIGS. 2 and 3) may also be positioned about the junctions 30, 35, 50 and 55, on the front and back side 12 and 14 separately, to guide a vehicle over and through the gaps while permitting a clear view of the junction.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A collision course comprising:

at least three track sections interconnecting to form at least two vertically disposed loop sections, defining at least a first and last vertical loop sections, each loop section having a beginning area, a looping area and an ending area, wherein the ending area of a preceding loop section feeds into the beginning area of a succeeding loop section, and wherein the ending area of the last loop section feeds into a beginning area of the first loop section; and each looping area intersecting at least one of the other looping areas to define an intersection, each intersecting looping area having a gap at said intersection such that a vehicle may travel uninhibited over or through the gaps of said intersecting looping areas, wherein when two vehicles, traveling along different vertical loop sections, enter the same intersection at the same time and come into contact with each other adjacent a gap on one of the intersecting looping areas, of said intersection, a mid-air collision will occur between the vehicles.

2. The collision course of claim 1 wherein the looping area of each vertically disposed loop section is unsymmetrical, such that the ending area of the first vertical loop section is at a predetermined height above the beginning area of the first vertical loop section and the ending area of the last vertical loop section is at a predetermined height below the beginning area of the last vertical loop section.

3. The collision course of claim 2 further comprising:

a pair of power driven rollers positioned at the beginning area of each vertical loop section, each pair of power driven rollers is sufficiently spaced to receive and to impel a toy vehicle through the vertical loop sections and through the intersections;

the beginning area of a succeeding vertical loop section is positioned directly above the beginning area of a preceding vertical loop section, such that the vertical loop sections are substantially planar; and a drive mechanism rotating a single pair of axles, each pair of power driven rollers attached to the single pair of axles, such that the drive mechanism rotates each pair of power driven rollers.

4. The collision course of claim 3 further comprising:

an entrance track section interconnected to the beginning area of the first loop section, which allows a toy vehicle to enter the collision course, the entrance track section forms a part of and intersects the last loop section at an entrance gap, formed in the last loop section, whereby the entrance track section passes through the last loop section at said entrance gap.

5. The collision course of claim 4 further comprising:

an exit track section interconnected to the beginning area of the first looping section, which permits a toy vehicle traveling along the exit track section to exit the collision course, the exit track section forms a part of and intersects the first loop section at an exit gap, formed in the first loop section, whereby the exit track section passes through the first loop section at said exit gap, such that a toy vehicle may travel along the first loop section and exit the collision course through the exit gap.

6. The collision course of claim 5 further comprising:

an exit door pivotally attached to the exit track section over said exit gap and having an up or a down position, wherein in the down position a toy vehicle traveling along the beginning area moves up the exit door and continues to travel along the first loop section, and wherein when the exit door is in the up position, a toy vehicle may travel through the exit gap and leave the collision course.

7. The collision course of claim 1, wherein the at least three track sections include at least four track sections interconnecting to form at least three vertically disposed loop sections, the at least three vertically disposed loop sections further defining an intermediate vertically disposed loop section having a beginning area, a looping area and an ending area, and wherein the intermediate vertical loop section is interposed between the first and last vertical loop section, wherein the ending area of the first vertical loop section feeds into a beginning area of the intermediate vertical loop section and wherein an ending area of the intermediate vertical loop section feeds into the beginning area of the last loop section.

8. The collision course of claim 7 comprising four intersections, wherein two intersections are defined by the intersection of the first and intermediate vertical loop sections, one intersection is defined by the intersection of the first and last loop sections and one intersection is defined by the intersection of the intermediate and last loop sections.

9. A vertical extending collision course for use in a track system comprising:

an entrance and an exit track section for inter connecting the vertical extending collision course with the track system and whereby a toy vehicle enters the course via the entrance section and exits the course via the exit section;

at least three track sections interconnecting with each other to form at least two vertically disposed loop sections, defining at least a first and last vertical loop section, each vertical loop section having a beginning area, a looping area and an ending area, wherein the ending area of a preceding vertical loop section feeds into the beginning area of a succeeding vertical loop section, and wherein the ending area of the last vertical loop section feeds into the beginning area of the first vertical loop section, and the beginning area of the first vertical loop section interconnects with the entrance and exit track section; and at least one junction defined by intersecting at least one of the looping areas, of said vertical loop sections, with at least one other looping area, each intersecting looping area has a gap at said intersection such that a vehicle may travel uninhibited over or through the gaps of said intersecting looping area, whereby if two vehicles, traveling along different vertical loop sections, enter the same junction at the same time and come into contact with each other adjacent a gap on one of the intersecting looping areas, a mid-air collision will occur between the vehicles.

10. The collision course of claim 9 further comprising:

an intermediate vertically disposed loop section having a beginning area, a looping area and an ending area, and interposed between the first and last vertical loop section, wherein the ending area of the first vertical loop section feeds into a beginning area of the intermediate vertical loop section and wherein an ending area of the intermediate vertical loop section feeds into the beginning area of the last loop section.

11. The collision course of claim 10 wherein the looping areas of each vertically disposed loop section is unsymmetrical, such that:

(a) the ending area of the first vertical loop section is positioned at a height higher than the beginning area of said first vertical loop section;

(b) the ending area of the intermediate vertical loop section is positioned at a height higher than the beginning area of said intermediate vertical loop section; and (c) the ending area of the last vertical loop section is positioned at a height lower than the beginning area of said last vertical loop section.

12. The collision course of claim 11 wherein the beginning area of a succeeding vertical loop section is positioned directly above the beginning area of a preceding vertical loop section, such that the vertical loop sections are substantially planar.

13. The collision course of claim 12 further comprising:

three vertically stacked pair of power driven rollers to engage and impel a toy vehicle through said loop sections and over and through the gaps defined at each junction, the three vertically stacked pair of driven rollers are separately disposed at each beginning area and are powered by a drive mechanism.

14. The collision course of claim 13 comprising four junctions, wherein two junctions are defined by the intersection of the first and intermediate loop areas, one junction is defined by the intersection of the first and last loop area and one junction is defined by the intersection of the intermediate and last loop areas.

15. The collision course of claim 14 wherein the entrance track section intersects the last loop section at an entrance gap formed in the last loop section, allowing a vehicle to enter the first beginning area by traveling through the entrance gap, and the exit track section forms a part of and intersects the first loop section at an exit gap formed in the first loop section, whereby a vehicle traveling through the exit gap may leave the collision course.

16. The collision course of claim 15 further comprising:

an exit door, through which a toy vehicle may exit the collision course, is pivotally attached to the exit track section over the exit gap, the exit door has an up or down position, wherein in the down position a toy vehicle may travel upward along the exit door to the first loop section, and when the exit door is in the up position a toy vehicle may travel through the exit gap and leave the collision course.

17. A collision course for toy vehicles comprising:

a plurality of track sections forming at least a first and last vertically disposed looping track areas, which intersect each other to form a plurality of junctions, each looping track area has a gap at said junction, such that a vehicle traveling along a looping track area through a junction may travel uninhibitedly through the gap of an intersecting looping track area, wherein if two vehicles, traveling along different looping track areas, enter the same junction at the same time and come into contact with each other adjacent a gap on one of the intersecting looping areas of said junction, a mid-air collision will occur between the vehicles;

each looping track area is defined by a beginning area, an upwardly extending curved section, an apex, a downwardly extending curved section and an ending area, wherein the ending area of a preceding vertically disposed looping track area feeds into the beginning area a succeeding vertically disposed looping track area and wherein the last vertically disposed looping track area feeds into the beginning area of the first vertically disposed looping track area;

a pair of power driven rollers disposed at each beginning area for engaging and impelling a toy vehicle through said looping track areas and through said junctions; and a means for driving the each pair of power driven rollers.

18. The collision course of claim 17 further comprising:

three vertically disposed looping track areas, defined as the first, an intermediate and the last vertically disposed looping track areas, whereby the three vertically disposed looping track areas intersect with each other to form four junctions, wherein (a) one junction is defined by intersecting the upwardly extending curved section of the first vertically disposed looping track area with the upwardly extending curved section of the intermediate vertically disposed looping track area, (b) one junction is defined by intersecting the upwardly extending curved section of the first vertically disposed looping track area with the upwardly extending curved section of the last vertically disposed looping track area, (c) one junction is defined by intersecting the downwardly extending curved section of the first vertically disposed looping track area with the downwardly extending curved section of the intermediate vertically disposed looping track area, and (d) one junction is defined by intersecting the upwardly extending curved section of the intermediate vertically disposed looping track area with the upwardly extending curved section of the last vertically disposed looping track area.

19. The collision course of claim 18 wherein the looping track area of each vertically disposed looping track area is unsymmetrical, such that:

(a) the ending area of the first vertically disposed looping track area is positioned at a height higher than the beginning area of said first vertically disposed looping track area, (b) the ending area of the intermediate vertically disposed looping track area is positioned at a height higher than the beginning area of said intermediate. vertically disposed looping track area, and (c) the ending area of the last vertically disposed looping track area is positioned at a height lower than the beginning area of said last vertically disposed looping rack area.

20. The collision course of claim 19 further comprising:

substantially planar vertically disposed looping track areas defined such that the beginning area of a succeeding vertical loop section is positioned directly above the beginning area of a preceding vertical loop section; and a pair of axles rotatably driven by the driving means and attached to each pair of power driven rollers, whereby each pair of power driven rollers are rotatably driven by a single driving means.

* * * * *